US005988123A

United States Patent [19]

Miyoshi et al.

[11] Patent Number: 5,988,123

[45] Date of Patent: Nov. 23, 1999

[54] METHOD OF CONTROLLING AN ELECTRIC VALVE DRIVE DEVICE AND A CONTROL SYSTEM THEREFOR

[75] Inventors: Noriomi Miyoshi; Kizuku Ohtsubo, both of Kawasaki, Japan

[73] Assignee: Fuji Oozx, Inc., Kanagawa-ken, Japan

[21] Appl. No.: 09/210,289

[22] Filed: Dec. 11, 1998

[30] Foreign Application Priority Data

| | | | |
|---|---|---|---|
| Jul. 15, 1998 | [JP] | Japan | 10-200088 |
| Jul. 15, 1998 | [JP] | Japan | 10-200091 |
| Oct. 2, 1998 | [JP] | Japan | 10-281161 |

[51] Int. Cl.[6] ..... F01L 9/04

[52] U.S. Cl. ..... 123/90.11

[58] Field of Search ..... 123/90.11

[56] References Cited

U.S. PATENT DOCUMENTS 5,598,814 2/1997 Schroeder et al. ..... 123/90.11

FOREIGN PATENT DOCUMENTS 2063158 6/1972 Germany ..... 123/90.11

10-37726 2/1998 Japan .

10-141028 5/1998 Japan .

*Primary Examiner*—Noah P. Kamen

*Attorney, Agent, or Firm*—Sheldon & Mak

[57] ABSTRACT

A poppet valve which has a valve stem is moved up and down to open and close a valve port in an internal combustion engine of a vehicle such as an automobile. A moving coil is wound on a bobbin mounted to the valve stem, and a magnet is mounted to a yoke fixed to a cylinder head. A plurality of sensors detect working conditions of the engine to send a signal to a working condition discriminating portion of CPU. The signal is further sent to a valve timing lift pattern memory in which optimum valve timing and lift are set corresponding to the working conditions to generate an optimum valve position signal. In the meantime, an actual position of the valve is detected by a sensor on the yoke to send an actual valve position signal to a valve position detector. In a comparator, the actual valve position signal from the valve position detector is compared with the optimum valve position signal from the valve timing lift pattern memory to apply to an electric current to the moving coil to move the valve up and down so that difference between the two signals may not occur.

9 Claims, 5 Drawing Sheets

METHOD OF CONTROLLING AN ELECTRIC VALVE DRIVE DEVICE AND A CONTROL SYSTEM THEREFOR

PRIORITY APPLICATION CLAIMS

This application claims priority from Japanese Patent Application No. 10-200088, filed on Jul. 15, 1998; Japanese Patent Application No. 10-200091, filed on Jul. 15, 1998; and Japanese Patent Application No. 10-281161, filed on Oct. 2, 1998, which are incorporated herein by reference.

BACKGROUND OF THE INVENTION

The present invention relates to a method of controlling an electric valve drive device which opens and closes an intake or exhaust poppet valve, and a control system therefor in an internal combustion engine.

A valve drive system in an ordinary engine mainly comprises a cam shaft, a rocker arm (or a tappet), a valve spring and a valve spring retainer, and rotation of the cam shaft driven by a crank shaft is transferred to a poppet valve via the rocker arm to make opening/closing movement.

Output performance and fuel efficiency of an engine generally depend on intake and exhaust efficiency, and the higher they are, the higher engine performance is obtained owing to smooth gas exchange in a cylinder.

However, an automobile engine has broad rotation range, so that it is difficult to improve engine performance over the whole operation range. If high speed performance is increased, low speed performance is decreased, and if low speed performance is increased, high speed performance is decreased.

To solve the problem, there is high-speed valve timing wherein lifts of intake and exhaust valves become larger to increase intake/exhaust efficiency to have larger overlapping area, while there is a small overlapping area valve timing wherein lifts become smaller to form a strong swirl at low speed where combustion is likely to be unstable.

Recently, to meet such requirements, an engine which has a valve operating mechanism of both low and high speed performance, or a variable valve timing lift mechanism which has two valve timing and lifts for low and high speeds is utilized.

However, the variable valve timing lift mechanism is basically similar to the mechanical valve operating mechanism which has the above cam shaft as drive source, and it is thus impossible to remove the performance decrease factor which such valve operating mechanism inherently has, or the performance decrease factor caused by mechanical loss and followability of a valve to a cam.

Valve timing and lift are determined by phase and profile of a cam, and it is impossible to vary them over the whole working range of the engine. There is actually no choice but to set two valve timings and lifts for low and high speed as above.

To solve the problem, as disclosed in Japanese Patent Laid-Open Pub. Nos. 10-37726 and 10-141928, it has been suggested to provide an electromagnetic valve drive device in which a valve is opened and closed by magnetic force instead of mechanical valve drive system having a cam shaft. But, in such a electromagnetic valve drive device, the valve is merely opened and closed by attractive force of an electromagnet, thereby increasing seating noise and providing low responsiveness during operation.

Furthermore, because the control area for valve timing and lift is small, it is difficult to obtain optimum valve timing and lift corresponding to any working condition of an engine, and it would be impossible to improve engine performance over the whole working range.

There is a moving iron core or piece in the valve, so that inertial mass is increased during opening and closing of the valve to decrease responsiveness and reliability at control.

To overcome the disadvantages in the foregoing electromagnetic valve drive device, the applicant suggested an electric valve drive device in which a valve is driven by an electromagnetic actuator called a voice coil motor.

A moving coil is wound around a valve stem, and inside or outside the moving coil, a magnet is fixed so that magnetic flux may be generated in a direction perpendicular to winding of the moving coil. When an electric current is applied to the moving coil, the valve is driven by axial force according to Fleming's left hand rule.

The electric valve drive device provides advantageous large control area of valve timing and lift, but there is problem how to control valve timing and lift in an optimum condition corresponding to any working condition of an engine.

Furthermore, to control the electric valve drive device depending on the working condition of the engine, it is inevitable to provide a valve position detector for detecting actual position of the valve. There are difficulties in mounting position, detecting accuracy and durability against heat.

SUMMARY OF THE INVENTION

In view of the foregoing disadvantages in the prior art, it is an object of the present invention to provide a method of controlling an electric valve drive device, in which valve timing and lift are controlled in the optimum conditions corresponding to working conditions of an engine, thereby improving engine performance over the whole working range.

It is another object for the present invention to provide a control system of an electric valve drive device in an internal combustion engine to set the mounting position and the detecting method of a valve position detecting means to improve accuracy for detecting optimally actual position of the valve to and increase durability.

To overcome the foregoing disadvantage in the prior art, according to one aspect of the present invention, there is provided a method of controlling an electric valve drive device which has a moving coil on a valve stem and a magnet fixed to a stationary member so that magnetic flux may be generated in a direction perpendicular to winding of the moving coil, comprising the steps of:

- detecting working conditions of the engine by a plurality of sensors;
- selecting optimum valve timing and lift corresponding to the working conditions from predetermined valve timing and lift patterns to generate an optimum valve position signal;
- detecting actual position of the valve to generate an actual valve position signal;
- comparing the actual valve position signal with the optimum valve position signal; and
- applying an electric signal to the moving coil to move the valve up and down so that difference may not occur between said two signals.

Therefore, the valve can be opened and closed by selecting the optimum valve timing and lift for the working conditions from predetermined suitable pattern group, thereby increasing control range and improving output and fuel consumption performance over the whole operating range of the engine.

According to another aspect of the present invention, there is provided a control system for an electric valve drive device for moving a poppet valve having a valve stem in an internal combustion engine, said device having a moving coil mounted to the valve stem and a magnet fixed to a stationary member so that magnetic flux may be generated in a direction perpendicular to winding of the moving coil, said control system comprising:

a plurality of sensors for detecting working conditions of an engine;

means for discriminating the working conditions of the engine based on an output signal from said sensors;

a valve timing lift pattern memory which has optimum valve timing and lift corresponding to the working condition of the engine to generate an optimum valve position signal;

valve position detecting means for detecting actual valve position with respect to a stationary member to generate an actual valve position signal; and means for comparing the actual valve position signal with the optimum valve position signal to apply an electric current to said moving coil to move the valve up and down so that difference may not occur between said two signals.

Thus, the moving coil can be controlled corresponding to the whole operating conditions of the engine, thereby opening and closing the valve surely.

BRIEF DESCRIPTION OF THE DRAWINGS

The foregoing and other features and advantages of the present invention will become more apparent from the following description with respect to embodiments as shown in appended drawings wherein.

DESCRIPTION OF THE PREFERRED EMBODIMENTS

Figure 1:
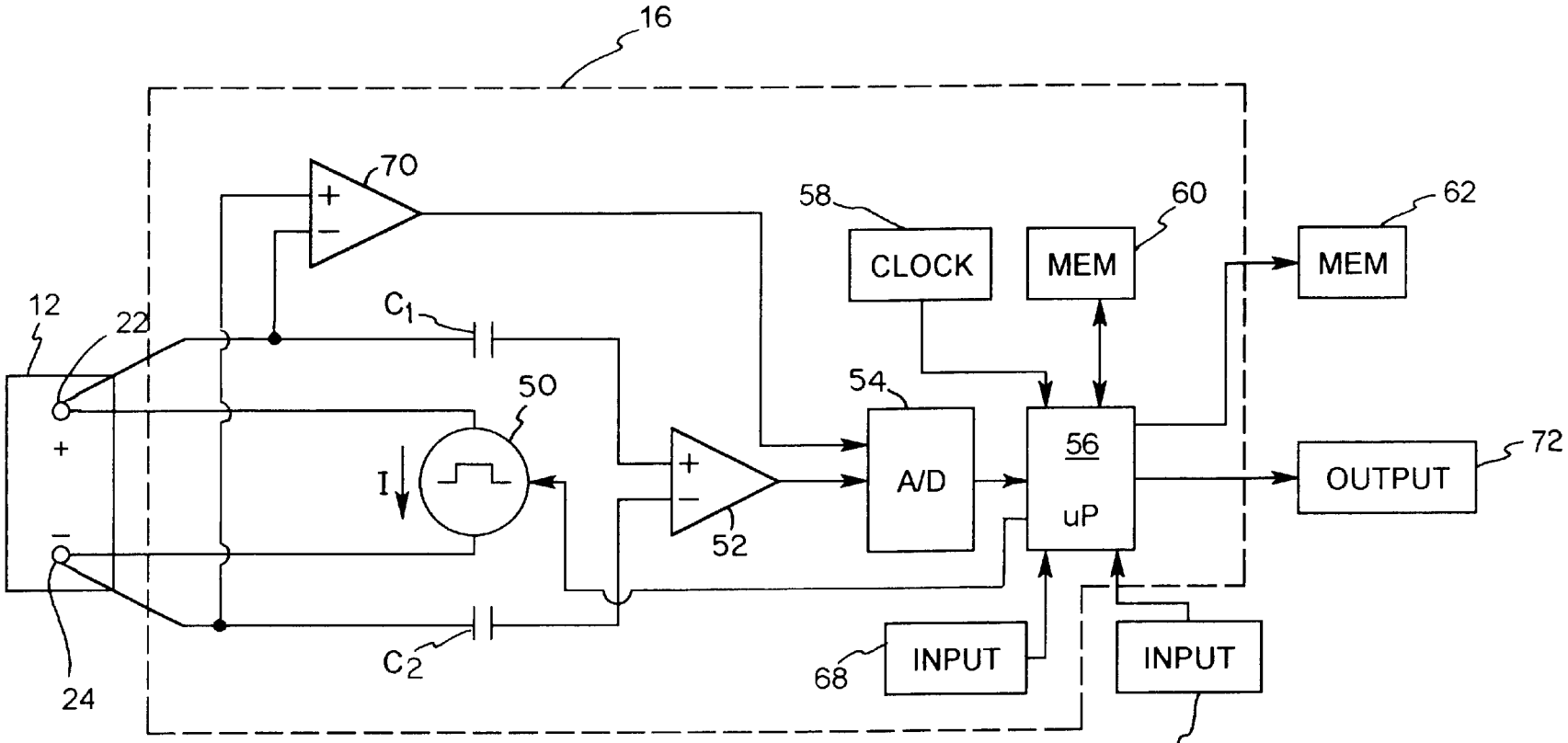
FIG. 1 is a block diagram which illustrates a control system according to the present invention and a central sectional front view of an electric valve drive device controlled thereby.

FIG. 1 illustrates an electric valve drive device "A" and a control system "B" therefor.

First, the valve drive device "A" will be described in detail. In a valve guide 2 which is a press fit in a cylinder head, a valve stem 3*a* of a heat resistant steel intake or exhaust poppet valve 3 is slidably engaged, and a valve head 3*b* at the lower end is engaged on a valve seat 4 which is a press fit in the opening end of an intake or exhaust port 1*a*, to seal the port 1*a*.

On the upper surface of the cylinder head 1, the lower end of a cylindrical bracket 2 coaxial with the valve 3 is fastened by a bolt 6, and a magnetic steel yoke 7 is fixed in the upper end of the bracket 5 by a plurality of bolts 6.

The yoke 7 has a central vertical air supply bore 8 and an annular cavity 9 which is concentric to the valve 3, and opens at the lower end. On an outer diameter inner circumferential surface of the annular cavity 9, a cylindrical permanent magnet 10 which has an outer N-pole and an inner S-pole (or vice versa) is fixed to provide a certain gap in the annular cavity 9.

Around a smaller-diameter portion at the upper end of the valve stem 3a of the poppet valve 3 in the bracket 5, a bottom plate 11*a* of a cylindrical moving coil support 11 is fixed by a nut 12 which is engaged on a male thread at the upper end of the smaller-diameter portion 3*c*.

Figure 2:
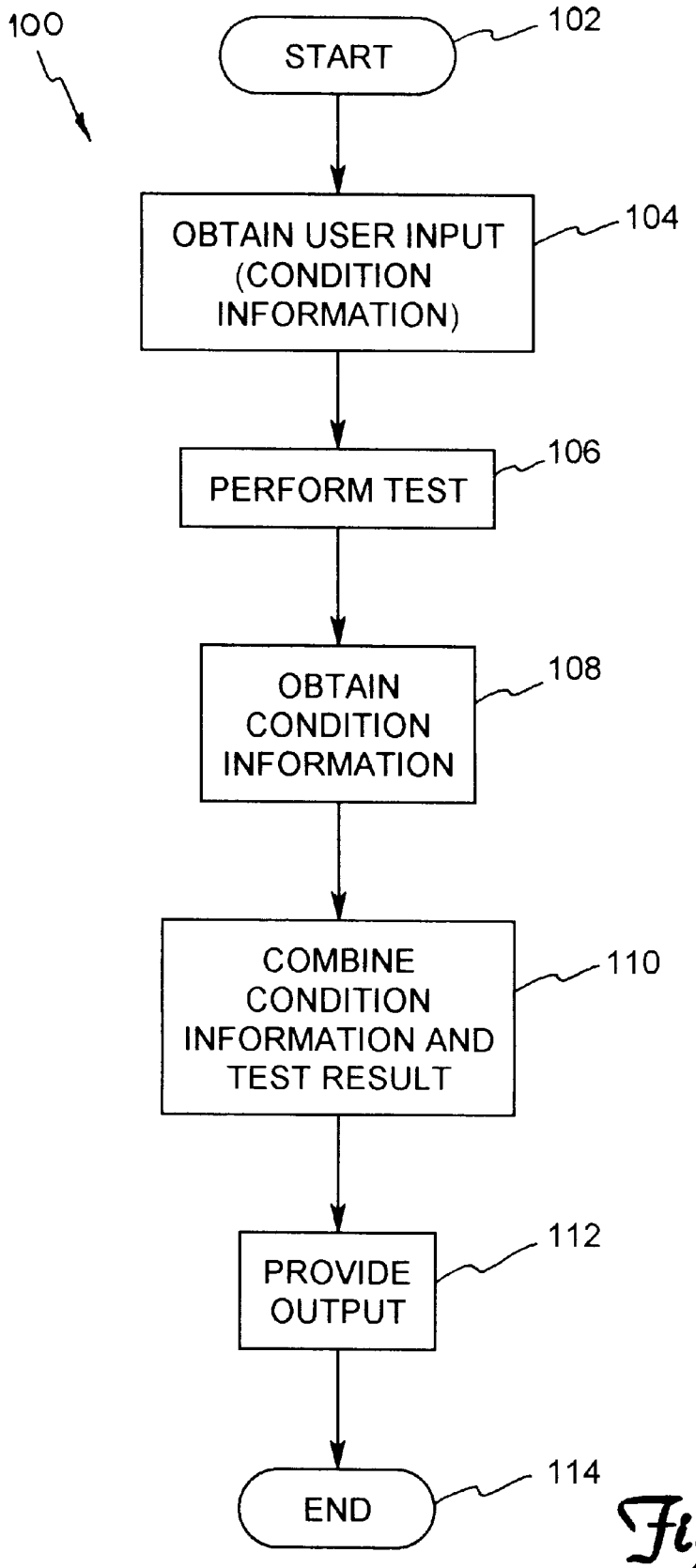
FIG. 2 is an enlarged vertical sectional view which shows the electric valve drive device and a moving coil wound thereon.

As shown in FIG. 2, a moving coil 13 is wound from the lower end in an axial direction on the outer circumferential surface of a thinner cylindrical bobbin 11*b* of the support 11 to constitute an even number of layers such as two layers in this embodiment. The reason for an even number of layers is that both the beginning and terminal ends of the coil 13 come to the lower end of the bobbin 11*b* to facilitate connection to a terminal as described below. The bobbin 11*b* and the moving coil 13 are placed with a small space between the permanent magnet 10 and the yoke 7 in the annular cavity 9.

As shown in FIG. 2, the moving coil 13 is covered with a glass or carbon fiber 14 and then impregnated by thermosetting resin such as epoxy resin having high heat resistance and mechanical strength, so that the coil 13 thus covered is cured and integrally fixed to the bobbin.

In order to decrease inertial mass during opening and closing of the valve 3, the support 11 may be preferably made of light metal such as Al alloy or rigid synthetic resin.

The permanent magnet 10 and the moving coil 13 constitute an electromagnetic actuator called "voice coil motor". In a gap in which the bobbin 11*b* (around which the moving coil 13 is wound) is placed, magnetic flux is generated in a direction perpendicular to a winding of the moving coil 13. Thus, when the electric current is applied to the moving coil 13, a force is generated according to Fleming's left hand rule, and moves the support 11 axially. Therefore, by controlling an electric current which flows through the moving coil 13, the valve 3 can be moved optionally in a vertical direction. Between a washer 15 on the cylinder head 1 and a hard spring receiver 16 which is engaged on the lower surface of a bottom plate 11*a* of the support 11, a compression spring 17 is provided, so that the valve 3 is always biased upwards. The upper end of the compression spring 17 is prevented from horizontal displacement by a circumferential projection 11*c* of the bottom plate 11*a*.

When an electric current is not applied, the compression spring 17 prevents the valve 3 from going down owing to self-weight of the valve 3 and mass of the support 11 and the moving coil 13 which is wound around it, to hold the valve 3 in a closed position. Thus, its spring constant may be smaller than that of a valve spring used in a valve operating mechanism of an ordinary engine.

At the lower end of the air supply bore 8 of the yoke 7, an electrode 18 for detecting position of the valve is fixed. In the electrode 18, a smaller diameter sensor shaft or iron core 3*d* which projects at the upper end of the valve stem 3*a* of the valve 3 is positioned without contact to the inner circumferential surface of the electrode 18. The electrode 18 and the sensor shaft 3*d* constitute an electrostatic capacity valve position detector, by which relative position of the yoke 7 and the sensor shaft 3*d* is detected to determine vertical displacement of the valve 3.

As shown in FIG. 2, terminals 13*a*,13*a* of the moving coil 13 are put in a guide portion 19 which projects downwards at the outer circumferential surface of the support 11, and is connected to a pair of terminal pins 20.

The terminal pin 20 is connected to a terminal pin 22 of an input terminal 21 mounted to the bracket 5 via a U-shaped flexible metal lead 23 made of phosphorous bronze. The metal lead 23 is deformed like rolling between the guide portion 19 and a guide portion 21*a* of the input terminal 21.

Into the air supply bore 8 of the yoke 7, cooling compressed air is fed through a connector 24 which is engaged in the bore 8 and an air pipe 25 connected therewith. Compressed air which flows in the bore 8 flows into the bracket 5 through a gap between the bobbin 11*b* and the yoke 7 and a gap between the outer circumferential surface of the moving coil 13 and the permanent magnet 10, and is discharged to the outside through a plurality of holes 26 of the bracket 5. By such air flowing, the electrode 18 and the moving coil 13 are cooled, thereby preventing overheat.

Compressed air may be fed from an air pump which is driven by an engine or an air tank.

Next, with respect to a block diagram in FIG. 1, the control system "B" for the valve drive device "A" and how to control by "B" will now be described as below.

Working condition of the engine is detected by a plurality of sensors which includes a crank angle sensor 27 mounted to the engine or vehicle and including (i) a crank angle basic position sensor and a cylinder identifying sensor, (ii) an engine rotation speed sensor 28, (iii) a throttle travel sensor 29, (iv) a vehicle speed sensor 30 and an acceleration/deceleration sensor 31 for obtaining other sensors (not shown), and an optimum valve position electric signal. Signals from the sensors 27, 28, 29, 30, and 31 are inputted to a working condition discriminating portion 33 in CPU 32 of a microcomputer.

Figure 3:
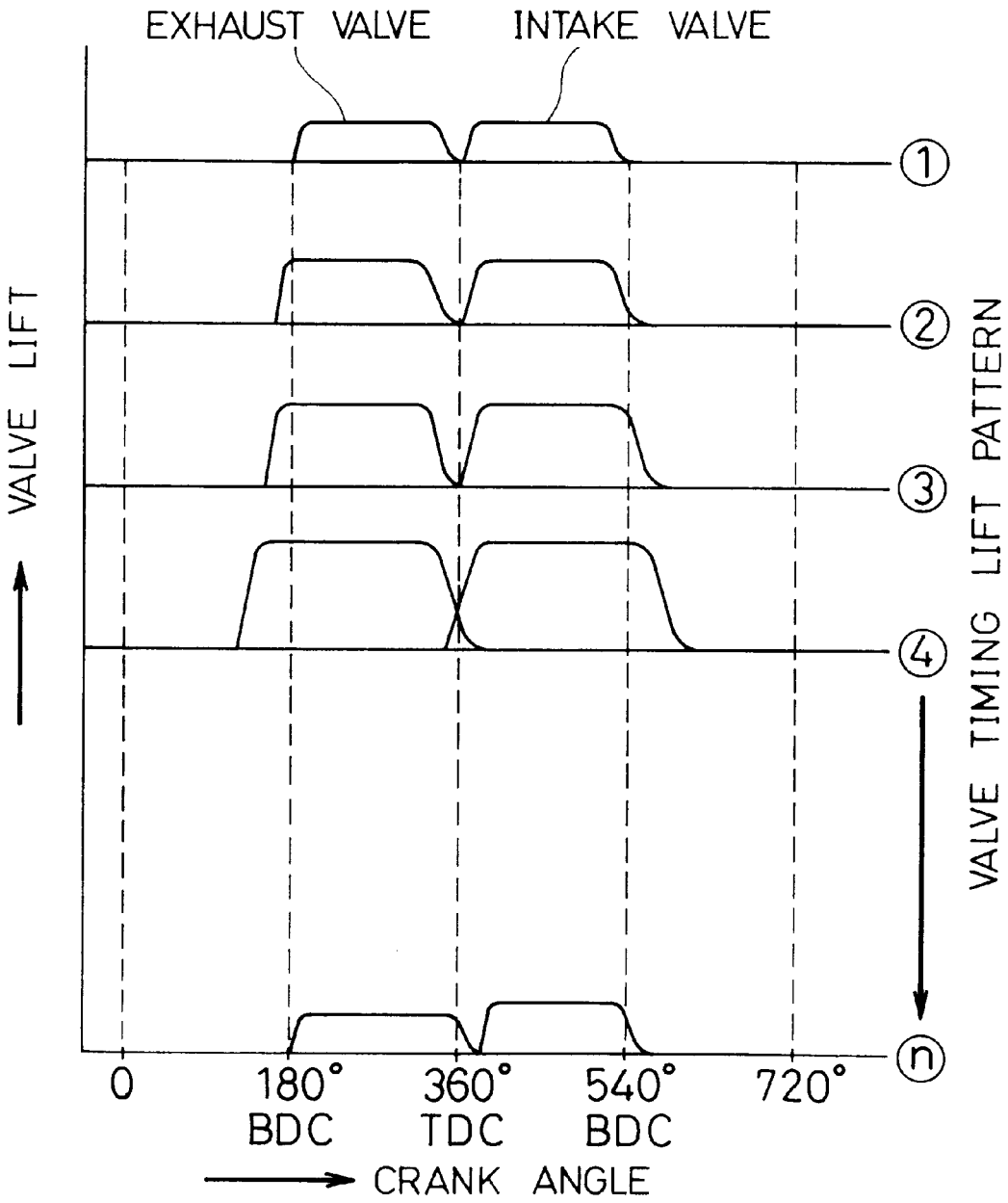
FIG. 3 is a graph which shows one example of a controlled pattern of valve timing and lift.

As shown in FIG. 3, CPU 32 has a valve timing lift pattern memory 34 in which an optimum valve timing lift pattern is previously set corresponding to an engine working condition in map of ① to (n) and stored in ROM, and a valve timing lift pattern selecting portion 35 for selecting optimum valve timing and lift determined based on the working condition discriminating portion 33 from the memory 34.

The optimum valve position electric signal selected from the valve timing lift pattern memory 34 is inputted to a comparator 36 to indicate an optimum position of the valve 3. The actual valve position electric signal which is outputted from the electrode 18 is converted to an electric signal corresponding to an exact valve position by a valve position detector 37 and inputted to the comparator 36.

In the comparator 36, the optimum valve position signal called out by the valve timing lift pattern memory 34 and the actual valve position signal from the electrode 18 are compared and calculated, so that the valve 3 is driven not to cause difference between the two position signals. That is to say, to agree the two position signals, intensity and direction of an electric current which flows through the moving coil are controlled with feed-back by the amplifier 38 connected to the input terminal 21, and the moving coil 13 and the support 11 are moved up and down, so that the valve 3 is driven with optimum timing and lift which is selected from the valve timing lift pattern memory 34.

The valve position detector 37 contains a full-closed position corrector for detecting the upper limit position and resetting to show closed position any time when the valve is closed to exact lift from the full-closed position of the valve 3, thereby preventing error of the present position caused by thermal expansion of the valve 3 and preventing wear on a valve face.

Figure 6:
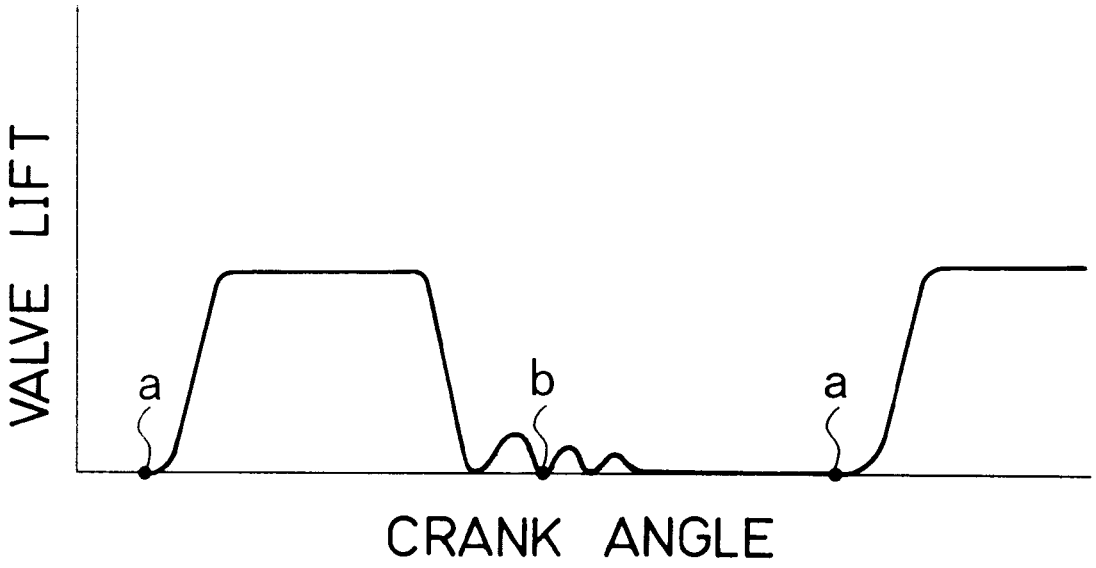
FIG. 6 is a graph which shows lift to a crank angle of the valve.

By the valve position detector 37, full-closed position of the valve 3 is detected at a position (a) just before the valve 3 is opened, or the lowest lift position (b) during opening and next opening of the valve 3, as shown in FIG. 6.

Even if the valve 3 should be bounced and opened just after closing, bouncing is finished and the valve 3 is completely closed at the position (a) just before opening, and even if bouncing is continued, the valve 3 is completely closed at the lowest position (b) on the way of bouncing, thereby avoiding any effects of bouncing. Therefore, valve timing and lift can be exactly determined on the basis of full-closed position of the valve 3.

In a multiple-cylinder engine, the control system "B" is provided for each of intake and exhaust valves of each cylinder to drive the intake or exhaust valve 3 separately.

As mentioned above, the electric valve drive device "A" of the present invention moves the moving coil 13 fixed to the axial end of the valve 3 in an axial direction to drive the valve 3, thereby avoiding the necessity of a heavy iron core on the moving valve 3, used as a conventional valve drive device for which attracting force by a electromagnet is used. Therefore, inertial mass is decreased during opening and closing of the valve to decrease seating noise of the valve and to increase responsiveness and reliability.

By controlling intensity and direction of the electric current in the moving coil 13, valve timing and lift can be optionally controlled, thereby increasing the control range considerably compared with a conventional electromagnet type device.

The electric valve drive device "A" contains a compression spring 17 which always biases the valve to a closed position, thereby preventing engagement of the valve 3 with the piston when an electric current is not applied to the moving coil 13 owing to inertia rotation after the engine stops with "off" of the engine and electrical failure.

The air supply bore 8 is formed in the center of the yoke 7, and compressed air introduced in the bore 8 is discharged to the outside via the holes 26 of the bracket 5 through a gap between the permanent magnet 10 and the moving coil 13, so that the moving coil 13 is directly cooled by air, thereby preventing rise in temperature.

The moving coil 13 comprises an even number of layers so that both beginning and terminal ends of the coil 13 are positioned to the same place, thereby facilitating connection with the terminal pin 20 or the input terminal 21.

The moving coil 13 is covered with glass or carbon fiber 14 and is impregnated with epoxy resin to cure, thereby increasing not only heat resistance but also tension and bending strengths and enduring vibration.

The terminal pin 20 of the moving coil 13 is connected to the terminal pin 22 of the input terminal 21 via the flexible elastic metal lead 23, so that rolling deformation is made when the support 11 moves up and down, thereby avoiding stoppage of electric current to the moving coil 13 caused by breakage of the metal lead 23.

The valve drive device "A" is controlled by the control system "B" in the foregoing embodiments to open and close the valve 3 with optimum valve timing and lift pattern as priorly set considering any working conditions of the engine, thereby expanding control range considerably and increasing output performance, fuel efficiency and exhaust gas performance over the whole working range of the engine.

As shown in FIG. 3, lift pattern during closing of the valve 3 is set to gently sloping, thereby decreasing seating noise by buffer effect when the valve 3 is seated.

The intake valve 3 itself can control intake amount of a mixed gas, thereby omitting a throttle valve.

Control of lift of the exhaust valve 3 to minimum during deceleration increases brake efficiency owing to an exhaust brake.

In the electric valve drive device "A", the permanent magnet 10 may be provided inside the moving coil 13.

After a key switch of the engine turns off, there may be provided a reserve power source for moving the moving coil 13 in a closing direction of the valve 3.

The compression spring 17 may be omitted in case of a horizontally opposing engine.

In the foregoing embodiment, an electrostatic capacity type sensor which comprises the electrode 18 and the sensor shaft 3d without suffering magnetic effect as valve position detecting means is used, but an eddy-current type sensor may be used.

Figure 4:
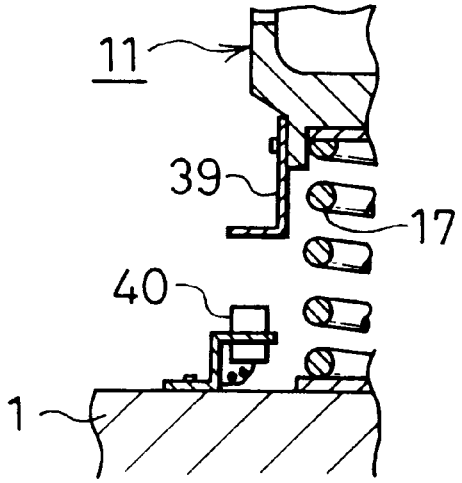
FIG. 4 is an enlarged vertical sectional view of a variation of means for detecting displacement of a valve.

In the embodiment, displacement of the axial end of the valve 3 is detected, but as shown in FIG. 4, a detecting metal piece 39 is mounted to the lower end of the support 11, and vertical displacement may be detected by a magnetic sensor 40 to detect displacement of the valve 3 indirectly.

Figure 5:
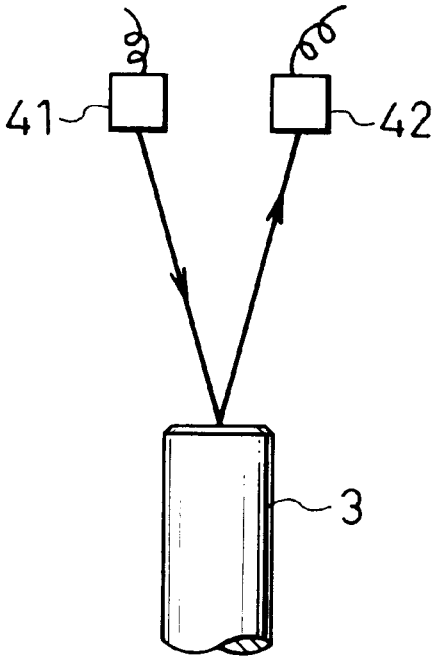
FIG. 5 is an embodiment of means for optically detecting displacement of a valve.

Instead of the foregoing detecting means, as shown in FIG. 5, displacement of the valve 3 may be detected by an optical sensor which comprises a light emitting portion 41 such as a laser and a light receiving portion 42. An ultrasonic wave may be transmitted to the axial end to detect displacement of the valve 3 directly. (not shown)

Instead of the permanent magnet 10 which constitutes the electromagnetic actuator, an electromagnet may be used.

The air supply bore 8 for cooling the moving coil 13 is not formed at the center of the yoke 7, but a plurality of air supply bores may be formed in the yoke 7 above the moving coil 13, or an air supply or discharge bore may be formed in the bracket to discharge heat of the bracket 5.

The foregoing merely relate to embodiments of the invention. Various modifications and changes may be made by person skilled in the art without departing from the scope of claims wherein:

What is claimed is:

1. A method of controlling an electric valve drive device for moving a poppet valve having a valve stem in an internal combustion engine, said electric valve drive device having a moving coil mounted to the valve stem and a magnet fixed to a stationary member so that magnetic flux may be generated in a direction perpendicular to winding of the moving coil, the method comprising:

detecting working conditions of the engine by a plurality of sensors;

selecting optimum valve timing and lift corresponding to the working conditions from predetermined valve timing and lift patterns to generate an optimum valve position signal;

detecting actual position of the valve;

generating an actual valve position signal based on the detected actual position of the valve, the actual valve position signal being corrected to represent closed position any time when the valve is closed;

comparing the actual valve position signal with the optimum valve position signal; and applying an electric signal to the moving coil to move the valve up and down so that difference may not occur between said two signals.

2. The method as defined in claim 1, further including amplifying the electric current after comparing of the two signals.

3. The method as defined in claim 1 wherein detecting actual position of the valve comprises detecting closed position when the valve is at a position just before the valve is opened or at the lowest position of lift during opening and next opening of the valve.

4. The method as defined in claim 1 wherein said stationary member comprises a yoke fixed to a cylinder head via a bracket.

5. The method as defined in claim 1 wherein said plurality of sensors comprise a crank angle sensor, a rotation speed sensor, a throttle travel sensor, a vehicle speed sensor and an acceleration/deceleration sensor.

6. A control system for an electric valve drive device for moving a poppet valve having a valve stem in an internal combustion engine, said device having a moving coil mounted to the valve stem and a magnet fixed to a stationary member so that magnetic flux may be generated in a direction perpendicular to winding of the moving coil, said control system comprising:

a plurality of sensors for detecting working conditions of an engine;

means for discriminating the working conditions of the engine based on an output signal from said sensors;

a valve timing lift pattern memory which has optimum valve timing and lift corresponding to the working conditions of the engine to generate an optimum valve position signal;

a valve position detector for detecting actual valve position with respect to a stationary member to generate an actual valve position signal;

a corrector for correcting the actual valve position signal to represent closed position any time when the valve is closed; and a comparator for comparing the actual valve position signal with the optimum valve position signal to apply an electric current to said moving coil to move the valve up and down so that difference may not occur between said two signals.

7. The control system as defined in claim 6, further comprising an amplifier for amplifying the electric current from the comparator.

8. The control system as defined in claim 6 wherein said plurality of sensors comprise a crank angle sensor, a rotation speed sensor, a throttle travel sensor, a vehicle speed sensor and an acceleration/deceleration sensor.

9. The control system as defined in claim 6 wherein the stationary member comprises a yoke fixed to a cylinder head via a bracket.

* * * * *